US005498510A

United States Patent [19]

Ogawa

[11] Patent Number: 5,498,510

[45] Date of Patent: Mar. 12, 1996

[54] METHOD FOR SIMULTANEOUSLY COATING AT LEAST TWO LAYERS TO MAKE A PHOTOGRAPHIC LIGHT-SENSITIVE ELEMENT

[75] Inventor: Kenji Ogawa, Kanagawa, Japan

[73] Assignee: Fuji Photo Film Co., Ltd., Kanagawa, Japan

[21] Appl. No.: 201,319

[22] Filed: Feb. 24, 1994

Related U.S. Application Data

[63] Continuation of Ser. No. 962,718, Oct. 19, 1992, abandoned.

[30] Foreign Application Priority Data

Oct. 17, 1991 [JP] Japan ..... 3-296681

[51] Int. Cl.[6] ..... G03C 1/00; G03C 3/00; G03C 1/76; G03C 1/005

[52] U.S. Cl. ..... 430/496; 430/631; 430/642; 430/539; 430/935

[58] Field of Search ..... 430/496, 523, 430/539, 631, 642, 935, 961

[56] References Cited

U.S. PATENT DOCUMENTS

| | | | |
|---|---|---|---|
| 2,761,791 | 9/1956 | Russell | 430/536 |
| 3,920,456 | 11/1975 | Nittel et al. | 430/523 |
| 3,936,303 | 2/1976 | Shiba et al. | 430/546 |
| 4,267,265 | 5/1981 | Sugimoto et al. | 430/961 |
| 4,746,588 | 5/1988 | Ditty et al. | 430/935 |
| 5,061,611 | 10/1991 | Sakata et al. | 430/935 |
| 5,310,637 | 5/1994 | Kurz et al. | 430/935 |

FOREIGN PATENT DOCUMENTS

| | | | |
|---|---|---|---|
| 1-131549 | 5/1989 | Japan | 430/935 |
| 1-205154 | 8/1989 | Japan | 430/935 |

OTHER PUBLICATIONS

Patent Abstracts of Japan, "Production of Color Forming Image Material," vol. 14, No. 138 (P-1022), Mar. 15, 1990 & JP-A-20 03 045 (Konica Corp) Jan. 1990.

Patent Abstracts of Japan, "Coating Method", vol. 15, No. 431 (C-881), Nov. 5, 1991 & JP-A-31 81 368 (Fuji Photo Film Co., Ltd.) Aug. 1991.

Patent Abstracts of Japan, "Coating Liquid Applying Method", vol. 15, No. 274 (P-1226) Jul. 11, 1991 & JP-A-30 92 846 (Konica Corp) Apr. 1991.

U.S. Statutory, Invention Registration H879, Suzuki et al. 430/530, published Mar. 1991.

Nagasaki et al, U.S. Statutory Invention Registration H 674, published Sep. 1989.

Suzuki et al., U.S. Statutory Invention Registration H 874, published Jan. 1991.

U.S. Statutory Invention Registration H 1003, Ishiwara et al, published Dec. 1991.

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

A coating method for producing a photographic light-sensitive element without unevenness of coating, even when coating is carried out with at least one coating composition containing a low boiling point solvent as an outermost layer and coating is carried out at a high speed using a multi-layer simultaneous coating method. In accordance with the invention, the following relationship is maintained:

$$C<0.2L$$

where C (wt %) is the concentration of a low boiling point solvent in a coating composition forming an outermost one of the coating layers, and L (cc/m$^2$) is a quantity of a wet coating per web unit area in a thickness from an inner surface of the outermost layer adjacent to the outer surface of the silver halide layer to a surface of said outermost layer.

3 Claims, 4 Drawing Sheets

METHOD FOR SIMULTANEOUSLY COATING AT LEAST TWO LAYERS TO MAKE A PHOTOGRAPHIC LIGHT-SENSITIVE ELEMENT

This is a continuing application of Ser. No. 07/962,718, filed Oct. 19, 1992 now abandoned.

BACKGROUND OF THE INVENTION

The present invention relates to a method for applying a liquid solution to a running web for use in producing photographic films, photographic printing paper, etc., (hereinafter referred to collectively as "photographic light-sensitive elements"), and particularly relates to a multi-layer simultaneous coating method.

In producing photographic light-sensitive elements, generally, emulsions of a so-called oil-in-water dispersion type are used. In producing such an emulsion, sometimes a low boiling point solvent such as ethyl acetate, butanol, or the like is used as an auxiliary solvent. When a liquid coating containing such a low boiling point solvent is used to form the outermost layer in a multi-layer simultaneous coating method, it is difficult to obtain a stable and uniform film coating. This is because if such a low boiling point solvent is contained even in small amounts in the outermost layer, the solvent in the liquid surface can easily be evaporated by contacting only a very weak flow of air. The nonuniform distribution of surface tension in the free surface of the coating composition caused thereby produces disorder in the liquid films and hence unevenness of coating.

To prevent such uneven coating from occurring, the following methods have been proposed:

(1) a method whereby the content of an organic solvent contained in the coating composition is not more than 5 wt % (see, for example, Japanese Unexamined Patent Publication No. Hei. 3-92846); and (2) a method whereby the content of a solvent in the outermost layer is not more than 1 wt %, or a method using an apparatus for weakening the air flow over the coating portion by use of an air shield (see, for example, Japanese Patent Application No. Hei. 1-320640).

However, in the case where the distance from the outermost vapor-liquid surface to the silver halide containing layer is small, or in the case where a large quantity of a low boiling point solvent is contained in the layer next to the innermost layer, it is not sufficient to use only the above-mentioned stabilizing method, even if the content of low boiling point solvent in the outermost layer is not more than 1 wt %. Uneven coating still results because of the uneven surface tension distribution caused by nonuniform evaporation on the liquid surface of the low boiling point solvent. Therefore, in the case where the silver halide containing layer is close to the liquid surface, when any thickness unevenness in coating occurs, even if it is slight, the thickness of the silver halide containing layer will also be nonuniform.

If the distance between the liquid surface and the silver halide containing layer is lengthened, no unevenness in coating occurs, even if the content of the low boiling point solvent in the outermost layer is about 1 wt %. In the case where a larger quantity of low boiling point solvent is contained in the inner layer next to the outermost layer, on the other hand, the low boiling point solvent contained in the inner layer will diffuse to the outermost layer liquid surface and evaporate to thereby cause unevenness in coating before the liquid film is deposited on the web and gels thereon, even if the content of the low boiling point solvent in the outermost layer is zero.

Such uneven coating can be reduced by appropriately selecting the type and content of the surface-active agent in the outermost layer. This is because such uneven coating is caused by the uneven surface tension distribution produced on the liquid surface. Such surface tension distribution is apt to be produced particularly in the case where the liquid surface is expanded. Therefore, uneven coating can be reduced by appropriately selecting the type and content of the surface-active agent so as to relieve the surface tension when the liquid surface is expanded.

SUMMARY OF THE INVENTION

It is accordingly an object of the present invention to provide a coating method in which coating can be carried out without producing any unevenness in the applied coating, even if at least one layer of the coating composition includes a low boiling point solvent as part of the outermost layer thereof and the coating composition is applied at a high speed by the use of a multi-layer simultaneous coating method.

The foregoing and other objects of the present invention are attained by a multi-layer simultaneous coating method for performing coating of a photographic light-sensitive element constituted by at least two layers, characterized in that the following relationship is satisfied.

$$C<0.2L$$

where C (wt %) represents the concentration of a low boiling point solvent in the coating composition for the outermost layer, and L ($cc/m^2$) represents the quantity of wet coating per web unit area within the thickness from the inner surface of the outermost layer adjacent to the outer surface of the silver halide layer to the surface of the outermost liquid layer.

Also, the concentration of a low boiling point solvent in an inner layer next to the outermost layer is preferably not less than 0.5 wt % nor more than 7 wt %.

The surface-active agent in the outermost layer may be of a type and be supplied in such a quantity that a difference of surface tension between points of film heights 0 and 6 cm measured by a film breaking method is within a range of not more than 5 dyne/cm.

For the multi-layer simultaneous coating method to be used in the present invention, known methods may be used. That is, a slide hopper coating method, for example, as disclosed in Japanese Examined Patent Publication No. Sho. 33-8977 or the like may be used. Also, a curtain coating method, for example, as disclosed in Japanese Examined Patent Publication No. Sho. 49-24133 may be used.

Examples of the web to be used in the practice of the present invention include paper, plastic films, resin coated paper, synthetic paper, and the like. Examples of the plastic film materials include, for example, polyolefins such as polyethylene, polypropylene, etc.; vinyl polymers such as polyvinyl acetate, polystyrene, etc.; polyamides Such as 6,6-nylon, 6-nylon, etc.; polyesters such as polyethylene terephthalate, 6-naphthalate, etc.; polycarbonate; and cellulose acetates such as cellulose triacetate, cellulose diacetate, etc. As for resin used for resin coated paper, polyolefins such as polyethylene, etc., are typically used, but the invention is not so limited. As for paper, polyolefin-laminated paper may be used, and the surface of the paper may be either smooth or embossed.

Examples of the coating composition containing a low boiling point solvent include various liquid composites selected according to usage, for example, a coating composition containing water soluble binders such as a silver halide emulsion layer, a primer coating layer, a protective layer, a filter layer, a backing layer, etc., in the case of photographic light-sensitive elements.

Examples of the low boiling point solvent to be used in the present invention include, for example, alcohols such as methanol, ethanol, n-propanol, etc.; ketones such as acetone, methylketone, etc.; and esters such as methyl acetate, ethyl acetate, n-butyl acetate, etc.

Examples of the surface-active agent to be used in the present invention include, for example, a nonionic surface-active agent such as glycidol derivatives, fatty-acid esters of multi-valent alcohol, alkyl esters of sugar, etc.; an anionic surface-active agent containing a base such as a carboxyl group, a sulfo group, a phosphoric group, a sulfuric ester group, etc.; and a fluorine-containing surface-active agent. Examples of the above-mentioned anionic surface-active agent include, for example, agents such as those as disclosed in Japanese Unexamined Patent Publication No. Sho. 53-21922 such as the organic sulfonic acid composition comprising at least one of the compounds represented by general formula (I)

$$A\text{–}SO_3M \qquad (I)$$

wherein A represents a monovalent residue of an unsaturated hydrocarbon having one double bond and containing 8 to 18 carbon atoms, and M represents a hydrogen atom, an alkali metal atom, an alkaline earth metal atom, an ammonium group or an alkylammonium group; and at least one of compounds represented by the general formula II $$B-\underset{\underset{OH}{|}}{CH}-(CH_2)_n-SO_3M \qquad (II)$$

wherein B represents a monovalent residue of a saturated hydrocarbon containing 6 to 16 carbon atoms, n is 1, 2 or 3, and M has the same meaning as M in the above general formula (I), and Japanese Examined Patent Publication No. Sho. 56-1617, such as anionic surface-active agents of the following formulas:

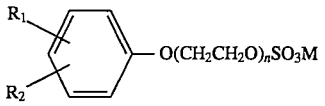

$R_1$: alkyl having 1–18 carbons; $R_2$: hydrogen or alkyl having 1–18 carbons and when $R_2$ is hydrogen, $R_1$ is $C_{1-7}$ alkyl; M: cation, n: 1–50 (these anionic surface-active agents have the features of increasing the coatability and preventing foaming of the phototreating solution of the alkylaryl-polyethersulfate-type compound; preferably, the alkyl group has two branches), and sulfate of alcohol, an alkyl sulfonate, dialkyl sulfo-succinate, α-sulfonate, and the like. Examples of the fluorine-containing surface-active agent include such agents as disclosed, for example, in Japanese Examined Patent Publication Nos. Sho. 47-9303 such as anionic perfluoro compounds corresponding to the following formula:

$$R_f-CO-O-X$$
$$R_f-SO_2-O-X-$$

-continued $$R_f-CO-\underset{\underset{R_2}{|}}{N}-R_1-CO-O-X$$

and above all $$R_f-SO_2-\underset{\underset{R_2}{|}}{N}-R_1-CO-O-X$$

$R_f$ represents an alkyl residue which is perfluorinated in the manner indicated, $R_1$ represents an alkylene residue, $R_2$ represents a hydrogen atom or an alkyl residue and X represents a hydrogen atom or an alkali metal atom, and Sho. 52-25087, such as fluorine-containing surface active agents of the following formula:

$$H(CF_2CF_2)_nCH_2OCH_2\underset{\underset{OB}{|}}{CH}CH_2A$$

In the above formula,

A: $-O(CH_2CH_2O)_mH$, $-OCH_2(CF_2CF_2)_1H$, $$-N\overset{\overset{CH_3}{|}}{C}H_2CH_2SO_3M,$$

$-SO_3M$,

B: H, $(CH_2CH_2O)_mH$;

M is cation, m: 1~100, n & 1: 1~9)

(this agent is added in a coating liquid so as to reduce the surface tension thereof. Therefore, the agent improves the coating ability of the coating liquid) and EP 0 144844 B1.

According to the present invention, the feature that the relationship of C<0.2L is satisfied, where C (wt %) represents the concentration of a low boiling point solvent in the outermost layer and L (cc/$m^2$) represents the quantity of wet coating per web unit area, results in reducing the unevenness in coating to a level where there is no problem in practical use. However, it is more preferable that the relationship of C<0.08L–0.4 be satisfied. On the other hand, if C and L are such as to satisfy the relationship of C≧0.2L, extreme unevenness occurs in coating to the extent of causing severe problems in practical use.

According to the present invention, that the concentration of a low boiling point solvent contained in an inner layer next to the outermost layer is made to be not more than 7 wt % reflects the facts that the amount of unevenness in coating becomes a problem in a practical use with a concentration of not less than 7 wt %, but that there is no problem if the concentration is not more than 7 wt %. It is more preferable to select the concentration to be not more than 3 wt %.

To reduce the concentration of the solvent in the coating composition, for example, in the case where the coating composition contains oil-in-water dispersion type emulsions produced by the use of a low boiling point solvent as an auxiliary solvent, there has been employed a desolvent treatment of the emulsion. As for the desolvent treatment of the emulsion, treatments which have been known for stabilizing emulsions, particularly for stabilization in passing time may be used, as disclosed, for example, in Japanese Examined Patent Publication No. Sho. 61-56010 and Japanese Unexamined Patent Publication Nos. Sho. 53-112731 and Sho. 53-74031. In this case, generally, the desolvent agent is limited to the extent of 10 wt % of the initial content in an oil-in-water dispersion type emulsion. Further, since the coating composition containing such an emulsion can be diluted with a silver halide emulsion, water soluble binder, water, or the like, the concentration of the solvent can be reduced.

Increasing the distance between the outermost layer liquid surface and the outermost layer side boundary of the silver halide containing layer can be realized by adding water to the outermost layer or a layer between the outermost layer and the outermost silver halide containing layer. Particularly in the case where the outermost layer contains much low boiling point solvent, the addition of water to the outermost layer may provide effects such that not only can the distance be increased, but also the concentration of the low boiling point solvent can be reduced.

BRIEF DESCRIPTION OF THE DRAWINGS

FIG. 3 is a schematic illustration of an apparatus for measuring surface tension according to Hei. 3-20640.

FIG. 4 is a schematic diagram of a liquid-film branching bar equipped with an air jet for causing the branching of a free-falling liquid film according to Hei. 3-20640: (a) a side view; and (b) a sectional view.

FIG. 5 is a schematic illustration of the principle of measuring the configuration of the edge of a liquid film by means of a CCD camera as in Hei. 3-20640.

FIG. 6 is a schematic illustration of the image processing principle using the CCD camera as in Hei. 3-20640.

DESCRIPTION OF THE PREFERRED EMBODIMENTS

Figure 1:
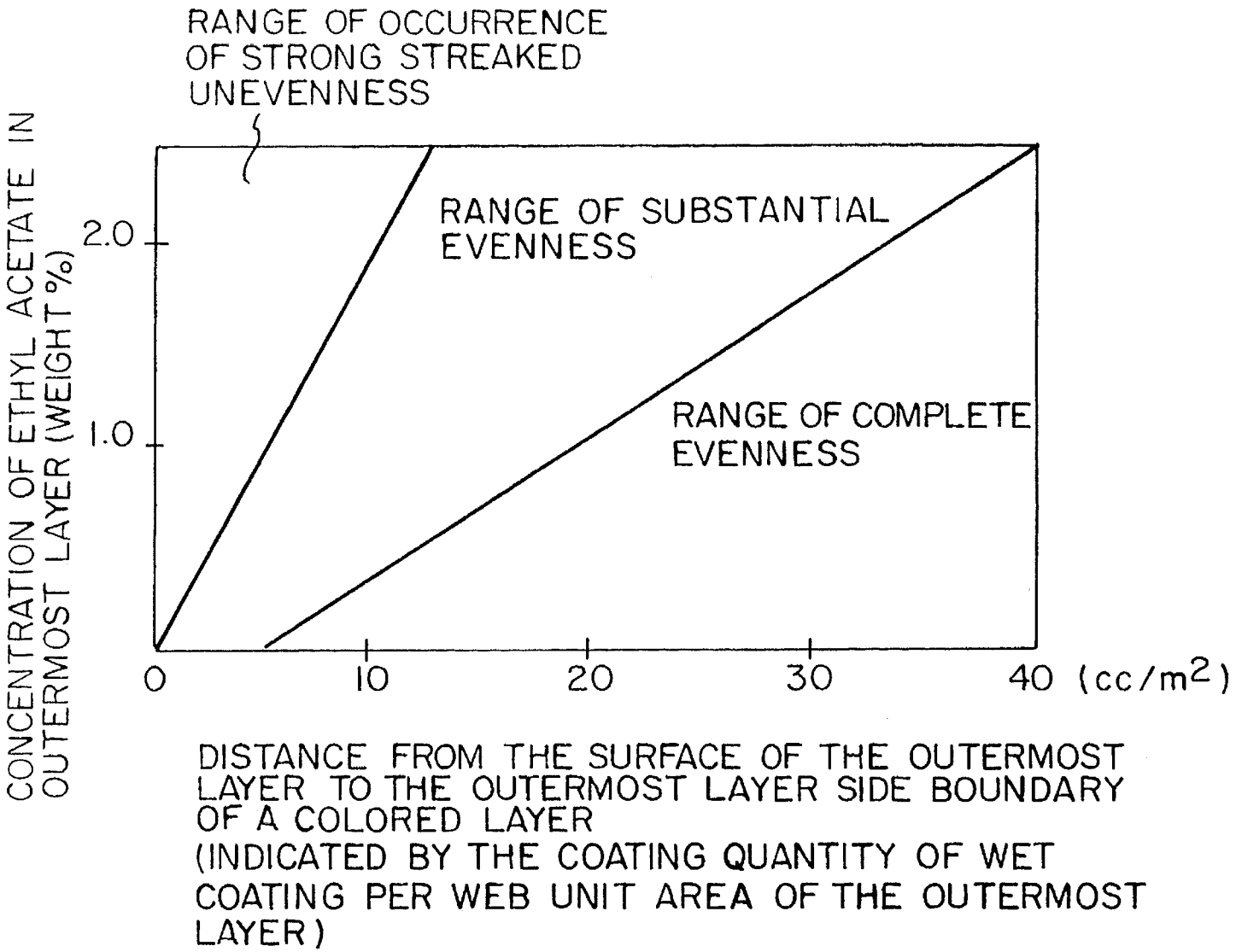
FIG. 1 is a diagram for distinguishing states of unevenness of coating in the relationship between the distance (expressed by the quantity of coating cc/m$^2$) from the surface of the outermost layer to the outermost layer side boundary of a colored layer.

The effects of the present invention can be confirmed by the use of colored layers, which can indicate unevenness of coating more clearly than silver halide containing layers.

COMPARATIVE EXAMPLE 1

Simultaneous coating of two layers was performed with the composition shown in Table 1 using a slide hopper coating apparatus.

TABLE 1

| Component | No. 1 colored layer (wt %) | No. 1 outermost layer (wt %) |
|---|---|---|
| Gelatin | 8.0% | 8.0% |
| $H_2O$ | 90.7% | 89.6% |
| Ethyl acetate (low boiling point solvent) | 0.0% | 2.0% |
| Anionic surface-active agent dodecyl benzene sodium sulfonate | 0.0% | 0.05% |
| Water soluble dyestuff | 1.0% | 0.0% |
| Water soluble thickener | 0.3% | 0.3% |
| Viscosity (centipoise) | 50 | 50 |
| Quantity of coating (cc/m$^2$) | 60 | 10.2 |

With the concentration of ethyl acetate in the outermost layer being 2.0 wt % under the concentration of a low boiling point solvent C, multi-layer simultaneous coating was performed on a cellulose triacetate film under the conditions that the coating quantity of the colored layer was 60 cc/m$^2$ the coating quantity of the outermost layer was 10.2 cc/m$^2$, and the coating speed was 100 m/min. As a result, coating unevenness in the form of parallel-streaks or streaks slightly shifted parallel to the advancing direction was strongly produced in the coated surface. The relationship between C and L was C=2=2.04=0.2L.

EXAMPLE 1

Using the colored layer as in Comparative Example 1, while changing the liquid composition and the coating quantity of the outermost layer as shown in Table 2, two layer simultaneous coating was performed twice with respect to two types of outermost layer in connection with the same colored layer.

TABLE 2

(wt %)

| Component | No. 2 outermost layer | No. 3 outermost layer |
|---|---|---|
| Gelatin | 6.0% | 4.0% |
| $H_2O$ | 92.2% | 94.4% |
| Ethyl acetate (low boiling point solvent) | 1.3% | 1.0% |
| Anionic surface-active agent dodecyl benzene sodium sulfonate | 0.05% | 0.05% |
| Water soluble thickener | 0.4% | 0.5% |
| Viscosity (centipoise) | 50 | 50 |
| Quantity of coating (cc/m$^2$) | 19.8 | 30 |

With respect to the concentration C of the low boiling point solvent, the concentration of ethyl acetate was 1.3 wt % in the second outermost layer and 1.0 wt % in the third outermost layer. The coating quantity was 19.8 cc/m$^2$ for the second outermost layer and 30 cc/m$^2$ in the third outermost layer. the valuation on the result of coating was as follows:

In the second outermost layer, unevenness in coating was hardly seen, and the relationship between C and L was C=1.3<3.96.

In the third outermost layer, no unevenness at all in coating was observed, and the relationship between C and L was C=1.0< 6.00.

In general, the more the values of C and 0.2L were separated, the better the obtained result in the coating unevenness.

Further, FIG. 1 shows results obtained by detailed investigations into the influence on the production of coating unevenness by the concentration of a solvent in the outermost layer, and the distance from the outermost layer side boundary of a colored layer further interior than the outermost layer with respect to the liquid surface under the above-mentioned conditions.

EXAMPLE 2

Setting the coating quantities of the outermost layer and the colored layer to 10.2 cc/m$^2$ and 50 cc/m$^2$, respectively, using the same composition for the outermost layer as in Comparative Example 1, while changing the composition of the colored layer among the three types shown in Table 3, two layer simultaneous coating was performed three times with respect to the three types of colored layers in connection with the same outermost layer.

TABLE 3

| | Colored layer | | | (wt %) Outermost layer |
|---|---|---|---|---|
| Component | No. 2 | No. 3 | No. 4 | No. 4 |
| Gelatin | 8.0% | 8.0% | 8.0% | 8.0% |
| $H_2O$ | 90.7% | 83.7% | 80.7% | 90.6% |
| Ethyl acetate/ methanol (l/l) | 0.0% | 7.0% | 10.0% | 1.0% |
| Anionic surface-active agent dodecyl benzene sodium sulfonate | 0.0% | 0.0% | 0.0% | 0.05% |
| Water soluble dyestuff | 1.0% | 1.0% | 1.0% | 0.0% |
| Water soluble thickener agent | 0.3% | 0.3% | 0.3% | 0.3% |
| Coating quantity (cc/m$^2$) | | 60 | | 10.2 |

The content of a low boiling point solvent in the colored layer was set to 0 wt %, 7 wt %, and 10 wt %, while the content of the low boiling point solvent in the outermost layer was 1.0 wt %.

As a result, in the second colored layer, streaked unevenness of coating was hardly seen, in the third colored layer, streaked unevenness was present in the coating but to an extent producing no problem in practical use, and in the fourth colored layer, strong streaked unevenness in the coating was produced.

The relationship between C and 0.2L was C=1< 2.04 in each case.

It can be understood from the above that good results can be obtained if the content of the low boiling point solvent in the colored layer is not more than 7 wt %, and streaked unevenness is reduced if the content of the low boiling point solvent in an inner layer next to the outermost layer is also made not more than 7 wt %.

EXAMPLE 3

The surface-active agent p-dodecyl benzene sodium sulfonate was replaced by a: polyoxyethylene octyl phenyl ether ethane sodium sulfonate of equivalent mole;

b: dioctyl sulfo sodium succinate of equivalent mole; and c: dioctyl sulfo sodium succinate of five-fold moles.

The other conditions of the liquid composition were the same as in Comparative Example 1.

When coating was performed under these conditions, for the surface-active agent a, streaked unevenness of the resulting coating was produced, but to an extent that there would be no problem in practical use. For the surface-active agent b, streaked unevenness of the resulting coating was hardly observed, while for the surface-active agent c, no streaked unevenness of the resulting coating was observed at all.

Figure 2:
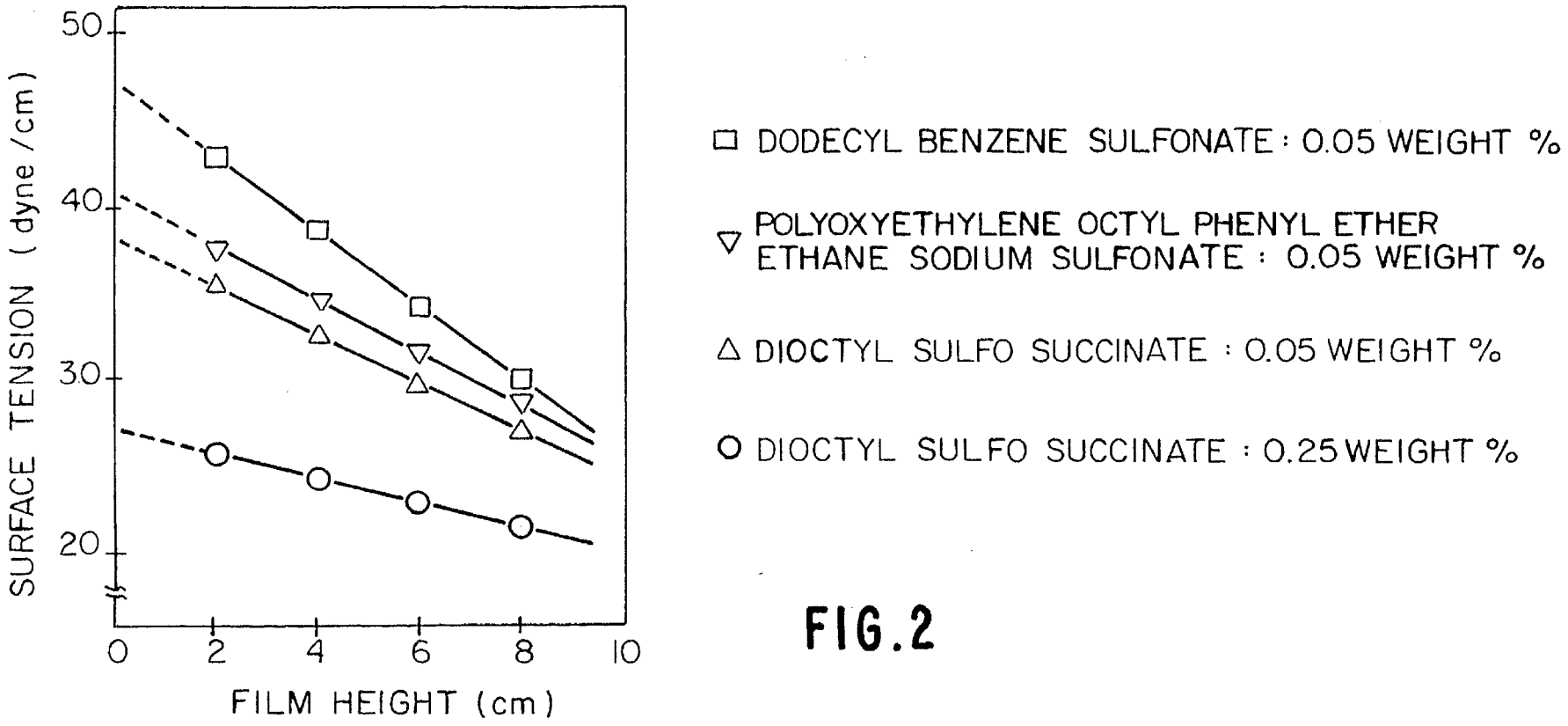
FIG. 2 is a diagram illustrating the relationship between film height and surface tension for different types of surface-active agents.

Further, the surface tension in each case was measured by a film breaking method. As shown in FIG. 2, the amount of streaked unevenness of coating is reduced if the conditions are set such as to reduce the change of surface tension. Although this result was obtained in the case of using 2 wt % ethyl acetate, almost the same result can be obtained in the range of 0 to 7 wt %. As for C and L, to eliminate problems of streaked unevenness in practical use for various surface-active agents, the following conditions should be maintained:

Comparative Example 1 (p-dodecyl benzene sodium sulfonate):

C<0.2L a. (polyoxyethylene octyl phenyl ether ethane sodium sulfonate):

C<0.25L b. (dioctyl sulfo sodium succinate):

C<0.3L

Unevenness of coating can be improved if a surface-active agent having a small change of surface tension is used.

The film breaking method used herein is a method for measuring surface tension, as disclosed, for example, in detail in Japanese Unexamined Patent Publication No. Hei. 3-20640. The measuring apparatus discussed in Hei. 3-20640 for measuring the surface tension comprises: two-dimensional optical sensor system containing an optical axis perpendicular to the liquid film through a subject portion to measurement of the liquid film; A/D (analog/digital convertor); and calculating circuit to calculate an angle of the subject portion to subject a digital signal from the A/D convertor to approximation relating to a shape of the edge of the liquid film by a multiple dimensional curve. Since the measuring apparatus can calculate the measured value in a moment corresponding to the shape of the edge of the broken liquid film by image processing, it is able to provide an apparatus realizing a precision measurement of the surface tension and increasing the number of kinds of measured subjects. Namely, the above apparatus determines a measurement according to the following formula:

$$2\sigma = Q.u.\sin^2\Theta + p.S.g.\sin\Theta - p.S.v^2/R$$

wherein, Q: flow rate in unit width, u: falling velocity, Θ: inclination of an edge of a liquid, σ: surface retention, S: cross section of a liquid film at the edge of the broken film, p: density of the liquid, v: velocity in the edge of the liquid film, R: radius of curvature of a liquid edge.

In greater detail, Hei. 3-20640 describes a method and apparatus for measuring surface tension and more particularly a method and apparatus effective in measuring surface tension of coating liquid to be spread on a surface using a free-falling liquid film. Prior to Hei. 3-20640, in reference to a method of measuring surface tension by putting a poor-wetting bar in a free-falling liquid film to cause the branching of the liquid film and then measuring the surface tension from the configuration of the liquid film that has thus branched off, Lin., S. P. has proposed, in *J. Col. Int. Sci.* (1980), to use the equilibrium between the surface tension and inertia force of the liquid.

Hei. 3-20640 describes a method of measuring surface tension by perpendicularly putting a poor-wetting bar in a free-falling liquid film to cause the branching of the liquid film and then measuring the surface tension from the configuration of the liquid film that has thus branched off, wherein, instead of a poor-wetting round bar as an insert bar, a poor-wetting bar having a recess which is perpendicularly open downward and from which air jets are sent out along the underside of the insert bar is put in for measuring purposes and employs as an apparatus for measuring surface tension, an apparatus comprising an insert which is perpendicularly put in a free-falling liquid film to cause the branching of the liquid film and a means for measuring the configuration of the liquid film that has thus branched off, wherein the insert is a poor-wetting bar having a recess which is perpendicularly open downward and embraces an air jet nozzle; and more particularly, an apparatus for measuring surface tension wherein the means for measuring the configuration of the liquid film that has thus branched off is provided with a two-dimensional sensor optical system having an optical axis perpendicular to the liquid film via the measuring portion thereof, an A/D converter and an operational circuit for computing the angle of the measuring portion, using a multidimensional curve to approximate the configuration of the end portion of the liquid film from digital electrical signals.

The poor-wetting bar having the recess which is perpendicularly open downward and from which air jets are sent out along the underside of the insert bar according to Hei. 3-20640 is not necessarily cylindrical but may be tubular. It is essential that the air jets are sent out along the underside of the insert bar. The poor-wetting means that the coating liquid has poor wetting properties and use is made of high polymer, which is preferably polytetrafluoroethylene, polychlorotrifluoroethylene or the like.

Since the insert of the apparatus for measuring surface tension according to Hei. 3-20640 is formed with the poor-wetting bar having the recess which is perpendicularly open downward and embraces the air jet nozzle, a reagent solution is blown off by air jets and prevented from sticking to the underside of the bar. The reagent solution is also prevented from reaching the underside of the poor-wetting bar as an air film is held on the underside thereof. Since the bar is so configured as to have the recess perpendicularly open downward, the underside of the bar hardly becomes wetted with the liquid. Therefore, the use of the insert according to Hei. 3-20640 prevents the liquid from thoroughly wetting the underside of the round bar and the branching of the liquid film from becoming indistinct as in the conventional method. In other words, the branching of the liquid film can thus be implemented quickly and stably. Measurement can also be made on the surface with the long lapse of time even in the case of viscous liquids.

Since the means for measuring the configuration of the liquid film that has thus branched off according to Hei. 3-20640 is provided with the two-dimensional sensor optical system having an optical axis perpendicular to the liquid film via the measuring portion thereof, the A/D converter and the operational circuit computing the angle of the measuring portion, using the multidimensional curve to approximate the configuration of the end portion of the liquid film from the digital electrical signals, the configuration of the edge of the liquid film that has thus branched off can instantly be imaged so as to obtain measured values. Consequently, it is made feasible to measure surface tension with accuracy as compared with the prior art method and to enlarge a range of intended measurements.

More specifically, the following expression has been used to calculate surface tension from the configuration of the edge of the film caused to branch off in the conventional measuring method:

$$2\sigma Q.\mu.\sin^2\Theta$$

where

Q: mass flow rate per unit width film;

μ: free falling velocity;

Θ: branching angle; and

σ: surface tension.

On the other hand, the measuring apparatus according to Hei. 3-20640 makes usable a calculating expression as noted above in which more factors have been taken into consideration:

$$2\sigma=Q.\mu.\sin^2\Theta+p.S.g.\sin\Theta-p.S.v^2/R$$

where

S: sectional area of the edge of the liquid film caused to branch off (the cross section of the edge being columnar);

p: liquid density;

g: acceleration of gravity; and v: curvature radius of the edge of the liquid film caused to branch off (though a read sensor is hardly usable for finding out the curvature from a photograph, the two-dimensional image sensors can make it available through image processing).

Figure 3:
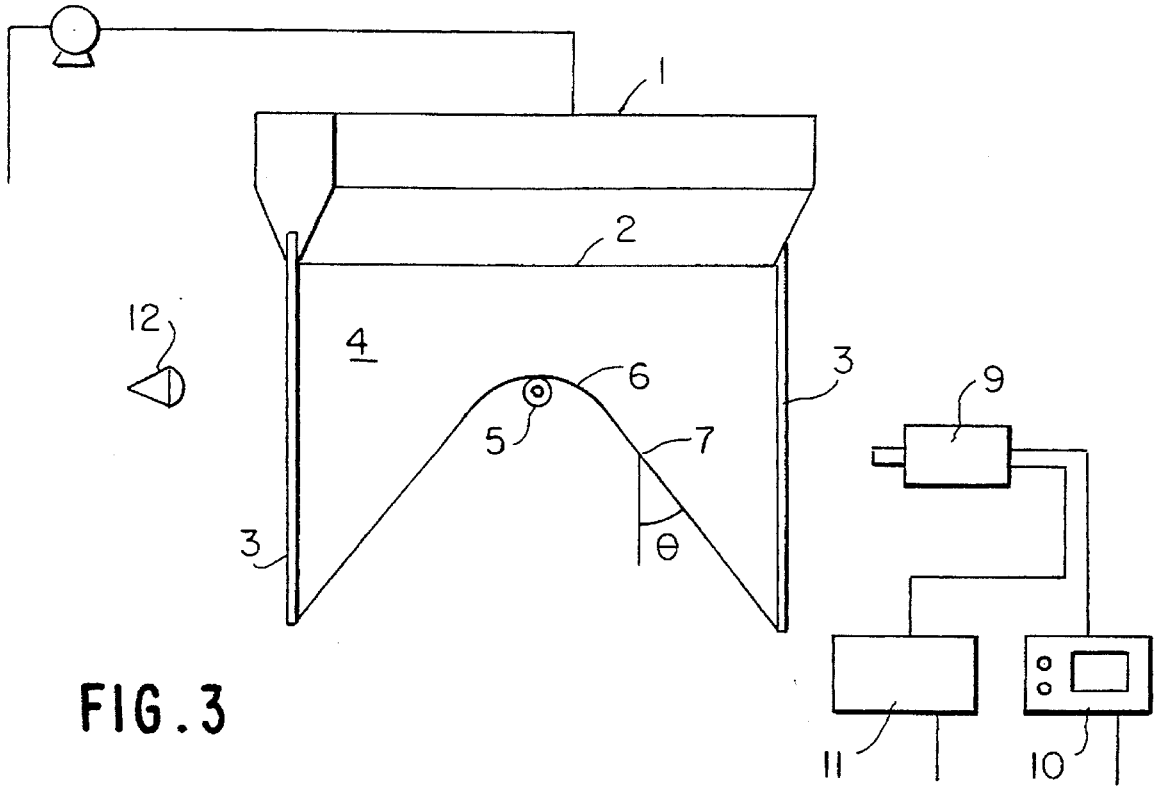
FIGS. 3 to 6 relate to an apparatus for measuring surface tension by a film breaking method described in Japanese Unexamined Patent Publication No. Hei. 3-20640.
Figure 4A:
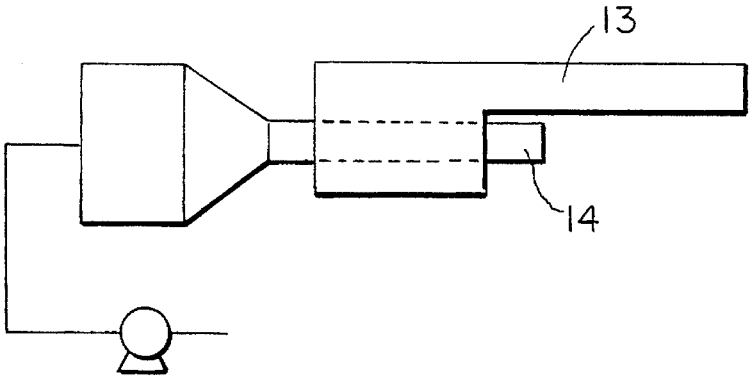
Figure 4B:
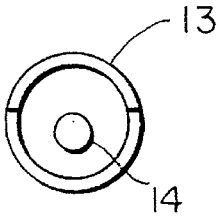
Figure 5:
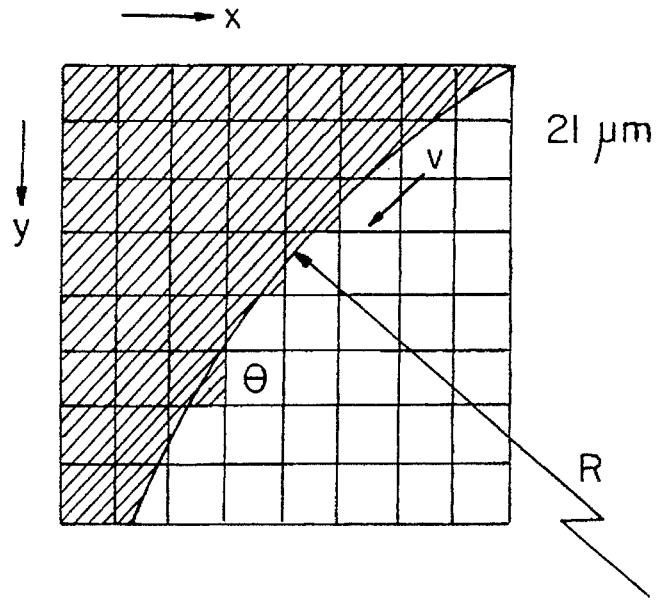
Figure 6:
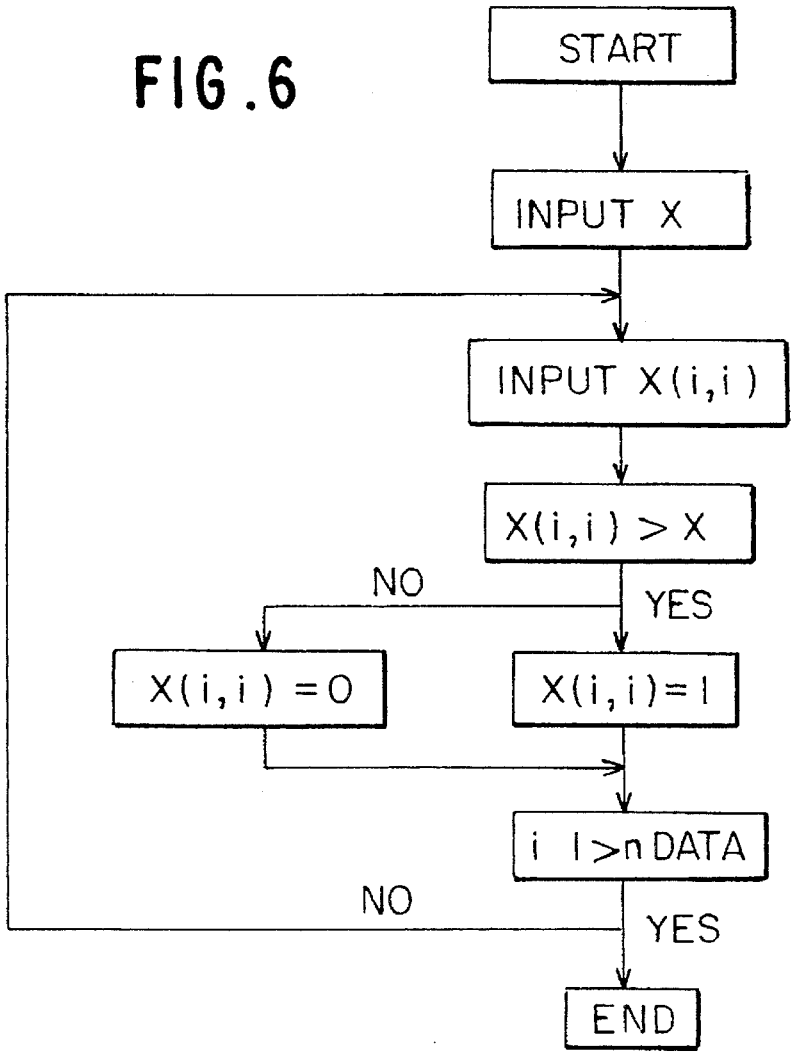

FIG. 3 depicts an apparatus for measuring surface tension according to Hei. 3-20640. FIG. 4(*a*) and 4(*b*) depict an insert bar to be put in a free-falling liquid film according to Hei 3-20640. FIG. 5 is a schematic illustration of the principle of measuring the configuration of the edge of a liquid film by means of a CCD camera. FIG. 6 is a flow chart for processing a signal from the CCD camera.

In FIG. 3, a liquid injected from a slit 2 of an extrusion type injector 1 forms a thin film 4 which is supported by a free fall supporting member 3. The thin film 4 is broken as like an arch 6 by a low-wetting type bar 5 which is inserted into the thin film 4. In the measuring method, an inclination Θ of an edge of a liquid at a measuring point 7 for the surface tension is subject to image processing by a two dimensional charged-coupled device camera 9 to display an image thereof on a monitor 10 and for calculation of the surface tension by a calculator 11. In order to measure the surface tension which varies in passing time due to the reorientation of the surfactant on the film surface, the measurement is conducted by changing the film height, i.e., changing the vertical distance between the slit 2 of the injector 1 and the low-wetting type bar 5 by which the film 4 is broken. A light source 12 is placed on the opposite side of the CCD camera 9 with the liquid film held therebetween.

FIG. 5 is a schematic illustration of the image sensors of the CCD camera and an image processing method.

As shown in FIG. 5, 512×512 of sensors 21 μm square are laid lengthwise and breadthwise. The configuration of the edge of the liquid film is determined by the intensity of light incident on the group of image sensors. The portion shown by oblique lines represents what is not transmitted by light because of the liquid film.

FIG. 6 is a flow chart showing a processing procedure in the operational circuit until the configuration of the edge of the liquid film is obtained from the signals taken in the group of image sensors.

The intensity X of light sensed by the image sensor is converted to a digital value X (i, i) in proportion to the intensity. Whether or not the liquid film exists in the part caught by one image sensor is determined by whether or not the digital signal is greater than a preset threshold value X". If the signal is greater than the threshold value, for example, no liquid film is present in that place. Subsequently, the image sensor that has caught the liquid film edge is defined by coordinates as shown in FIG. 5 and then a multidimensional curve is used to approximate the coordinates. The branching angle Θ is obtainable through the linear differential of the curve.

Moreover, the bar for effecting the branching of the film should preferably be made of poor-wetting material; the smaller its diameter is, the less it is affected by wetting. When a round bar is used for the branching of the liquid film, however, the reagent solution may go around the bar, thus making it impossible to measure the surface tension as the branching of the film is restrained. Therefore, as depicted by FIG. 4, a hollow bar 13 formed by removing its lower half portion and fitting an air jet nozzle 14 in that hollow portion is employed for the branching of the liquid film according to Hei. 3-20640. When the branching of the liquid film is conducted, an adequate quantity of air is steadily jetted from the air jet nozzle in proportion of the thickness of the liquid film so as to destroy the film in contact with the bar beforehand and then the bar proper is used to complete the branching of the film. As a result, this method ensures that the branching of the film is instantly conducted.

The condition that the difference of surface tension measured at two points of the film heights 0 and 6 cm from the slit 2 of the injector 1 in FIG. 3 is not more than 5 dyne/cm by use of values of surface tension measured by the film breaking method may be used as a standard to select the type of density of a surface-active agent having a small change of surface tension in passing time on the surface.

Structural formulae of the surface-active agents used in this example are shown in the following formulas 1 to 3.

[Formula 1]: p-dodecyl benzene sodium sulfonate,

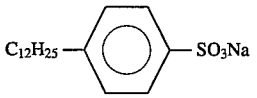

[Formula 2]: polyoxyethylene octyl phenyl ether ethane sodium sulfonate,

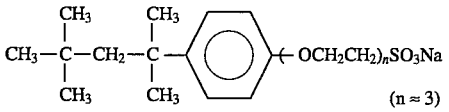

[Formula 3]: dioctyl sulfo sodium succinate,

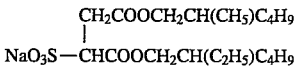

According to the coating method of the present invention, it is possible to perform coating without producing unevenness of coating, even if the coating is performed at a high speed by use of a multi-layer simultaneous coating method.

What is claimed is:

1. A multi-layer simultaneous coating method for producing a photographic light-sensitive element, said method comprising the step of simultaneously applying at least two layers to one side of a support, wherein the outermost of the at least two layers contains a low boiling point solvent, in which the following relationship is satisfied:

$$C<0.2L$$

where C(wt %) is the concentration of a low boiling point solvent in a coating composition forming said outermost of said at least two layers, and L ($cc/m^2$) is the quantity of wet coating per web unit area in a thickness of outer layer(s) above a silver halide layer from the inner surface of the outer layer which is adjacent to the outermost surface of the silver halide layer to the outer surface of said outermost of said at least two layers, and wherein a low boiling point solvent is present in the inner layer next to said outermost layer in a range of 0.5 to 7 wt %.

2. The coating method of claim 1, wherein a surface-active agent is in the outermost layer and is of a type and in a quantity yielding a difference of surface tension between points of film heights 0 and 6 cm in the composition forming said outermost layer as measured by a film breaking method of not more than 5 dyne/cm;

wherein the following relationship is satisfied:

$$C<0.08L-0.4.$$

3. The coating method of claim 1, wherein the concentration of the low boiling point solvent in the layer next to said outermost layer is not more than 3 wt %.

* * * * *